US012613045B2

(12) United States Patent
Buehrle

(10) Patent No.: US 12,613,045 B2
(45) Date of Patent: Apr. 28, 2026

(54) ROOF RIDGE VENT

(71) Applicant: Thomas Buehrle, Newport News, VA (US)

(72) Inventor: Thomas Buehrle, Newport News, VA (US)

( * ) Notice: Subject to any disclaimer, the term of this patent is extended or adjusted under 35 U.S.C. 154(b) by 245 days.

(21) Appl. No.: 18/599,909

(22) Filed: Mar. 8, 2024

(65) Prior Publication Data

US 2024/0302061 A1 Sep. 12, 2024

Related U.S. Application Data

(60) Provisional application No. 63/450,718, filed on Mar. 8, 2023.

(51) Int. Cl.
*F24F 7/02* (2006.01)

(52) U.S. Cl.
CPC ..... *F24F 7/02* (2013.01)

(58) Field of Classification Search
CPC ..... F24F 7/02
See application file for complete search history.

(56) References Cited

U.S. PATENT DOCUMENTS 4,201,121 A * 5/1980 Brandenburg, Jr. .... E04D 13/17 454/341
4,643,080 A * 2/1987 Trostle ..... F24F 7/02 52/716.2
4,676,147 A * 6/1987 Mankowski ..... E04D 13/174 454/365
4,817,506 A * 4/1989 Cashman ..... E04D 13/174 454/365

(Continued)

FOREIGN PATENT DOCUMENTS

AU 2012268780 A1 * 7/2014
CA 2717405 A1 * 4/2012 ..... E04D 13/17

(Continued)

OTHER PUBLICATIONS canplas.com/duraflo/blog/airfoil-technology-ridge-vents/, initially accessed Nov. 2022, current version dated Jun. 2, 2025.

(Continued)

*Primary Examiner* — Patrick J Maestri
(74) *Attorney, Agent, or Firm* — Renner, Kenner, Greive, Bobak, Taylor & Weber

(57) ABSTRACT

A roof ridge vent includes a lower assembly capped by an upper cover, the lower assembly and the upper cover being spaced apart via water crossover channels to form an inlet wind channel between first portions of the lower assembly and the upper cover and an outlet wind channel between second portions of the lower assembly and the upper cover. The water crossover channels can receive wind through openings to allow the wind and collected water to pass from the inlet wind channel to the outlet wind channel for drainage of the collected water. The spacing of the water crossover channels defines exhaust paths between respective pairs of the water crossover channels. The exhaust paths allow air to exhaust from an attic in an in-use configuration. Exhaust air travels through the exhaust paths before exiting one or more of the inlet wind channel and the outlet wind channel.

19 Claims, 8 Drawing Sheets

(56) References Cited

U.S. PATENT DOCUMENTS 4,957,037 A * 9/1990 Tubbesing ..... F24F 7/02 454/366
4,962,692 A * 10/1990 Shuert ..... E04D 13/174 454/365
5,022,203 A * 6/1991 Boyd ..... E04D 13/174 52/302.3
5,052,286 A * 10/1991 Tubbesing ..... F24F 7/02 454/365
5,174,076 A * 12/1992 Schiedegger ..... E04D 13/174 454/365
5,212,913 A * 5/1993 Whitehead ..... E04D 3/40 52/57
5,288,269 A * 2/1994 Hansen ..... E04D 13/174 454/365
5,427,571 A * 6/1995 Sells ..... E04D 13/174 454/365
5,603,657 A * 2/1997 Sells ..... F24F 7/02 454/359
5,704,834 A * 1/1998 Sells ..... F24F 7/02 52/149
5,921,863 A * 7/1999 Sells ..... E04D 13/174 454/359
6,128,869 A * 10/2000 Brotherton ..... F24F 7/02 52/302.1
6,233,887 B1 * 5/2001 Smith ..... E04D 13/176 52/198
6,267,668 B1 * 7/2001 Morris ..... E04D 13/174 454/365
6,277,024 B1 * 8/2001 Coulton ..... F24F 7/02 454/365
7,562,498 B2 * 7/2009 Galeazzo ..... F24F 7/02 52/302.1
8,151,524 B2 * 4/2012 Daddio ..... E04D 13/174 52/302.1
9,464,816 B1 * 10/2016 Marks ..... F24F 7/025
10,676,935 B1 * 6/2020 Huang ..... F24F 7/02
2001/0019941 A1 * 9/2001 Headrick ..... E04D 13/174 454/365
2002/0068522 A1 * 6/2002 Dixon ..... F24F 7/02 454/165
2002/0072324 A1 * 6/2002 Strait ..... F24F 7/02 454/365
2004/0132401 A1 * 7/2004 Rotter ..... E04D 13/176 454/365
2004/0237428 A1 * 12/2004 Headrick ..... E04D 13/176 52/198
2005/0054284 A1 * 3/2005 Ciepliski ..... E04D 13/176 454/365
2008/0028704 A1 * 2/2008 Cooper ..... F24S 10/73 52/302.1
2008/0064320 A1 * 3/2008 Polston ..... E04D 13/174 454/365
2008/0113612 A1 * 5/2008 Chich ..... F24F 11/49 454/367
2008/0287053 A1 * 11/2008 Carlson ..... E04D 13/174 454/365
2009/0049769 A1 * 2/2009 Kaseda ..... E04D 13/174 52/745.16
2011/0308178 A1 * 12/2011 Daddio ..... E04D 13/174 52/302.1
2012/0144763 A1 * 6/2012 Antonic ..... E04F 13/007 52/302.1
2013/0074428 A1 * 3/2013 Allen ..... E04D 13/174 52/302.1
2014/0308891 A1 * 10/2014 Holland ..... E04D 13/174 454/365
2016/0333574 A1 * 11/2016 Grubka ..... E04B 7/022
2016/0348946 A1 * 12/2016 Daniels ..... F24S 20/40
2016/0369513 A1 * 12/2016 Van Wey ..... F24F 7/02
2017/0146253 A1 * 5/2017 Mantyla ..... F24F 7/02
2017/0261233 A1 * 9/2017 Daniels ..... F24S 20/67
2017/0370610 A1 * 12/2017 Parry ..... B60H 1/26
2019/0249440 A1 * 8/2019 Hendricks, Jr. ..... E04D 13/174
2020/0340695 A1 * 10/2020 Munson, III ..... H02S 20/23
2024/0344329 A1 * 10/2024 Blevins ..... E04D 13/174
2025/0215691 A1 * 7/2025 Thompson ..... E04D 13/174
2025/0264235 A1 * 8/2025 Holland ..... F24F 7/02

FOREIGN PATENT DOCUMENTS

CA 2755006 A1 * 4/2012 ..... E04D 13/174
KR 20170143041 A * 12/2017 ..... F24F 7/10
WO WO-0218845 A1 * 3/2002 ..... E04D 1/3402

OTHER PUBLICATIONS youtube.com/watch?v=ecR8W_Q5FRw, video titled Ridge Vent Water Infiltration Test, published Jul. 11, 2011.

* cited by examiner

ROOF RIDGE VENT

CROSS-REFERENCE TO RELATED APPLICATIONS

This application claims the benefit of U.S. Provisional Application No. 63/450,718, filed on Mar. 8, 2023, which is incorporated herein by reference.

FIELD OF THE INVENTION

One or more embodiments of the present invention relate to a roof ridge vent. One or more embodiments of the roof ridge vent include hinged flaps and baffles to assist with separating out water from wind. One or more embodiments of the roof ridge vent include water crossover channels to allow wind and collected water to pass over to the other side.

BACKGROUND OF THE INVENTION

Roof ridge vents can be installed on a peak of a roof in order to exhaust air. Exhausting air from an attic is desirable in order to protect a roofing system and the attic. Improper or insufficient ventilation can cause problems, such as overheating, moisture buildup, and mold.

Certain roof ridge vents also attempt to account for water which is built up or collected after being blown into the roof ridge vent via wind. Some existing roof ridge vents can cause the collected water to get trapped, which can lead to the trapped collected water eventually spilling over into the attic or another undesirable location of the roofing system.

There remains a need in the art for an improved roof ridge vent which offers proper air exhaustion and water drainage, and which reduces or prevents intrusion of wind driven rainwater.

SUMMARY OF THE INVENTION

In one embodiment, the present invention provides a roof ridge vent for exhausting air and draining water, the roof ridge vent including a lower assembly capped by an upper cover, the lower assembly and the upper cover being spaced apart via a plurality of water crossover channels to thereby form an inlet wind channel between first portions of the lower assembly and the upper cover and an outlet wind channel between second portions of the lower assembly and the upper cover; the plurality of water crossover channels being configured to receive wind through respective openings therein to allow the wind and collected water to pass from the inlet wind channel to the outlet wind channel for drainage of the collected water; and a plurality of exhaust paths defined via spacing between respective pairs of the plurality of water crossover channels, the plurality of exhaust paths being configured to allow air to exhaust from an attic in an in-use configuration, the plurality of exhaust paths being adapted to allow the exhaust air to travel therethrough before exiting one or more of the inlet wind channel and the outlet wind channel.

DETAILED DESCRIPTION OF ILLUSTRATIVE EMBODIMENTS

One or more embodiments of the present invention relate to a roof ridge vent. The roof ridge vent includes one or more water crossover channels to allow wind and collected water to pass over to the other side of the roof ridge vent, for drainage of the collected water. One or more embodiments of the roof ridge vent include one or more hinged flaps and/or one or more vertical baffles to assist with separating out water from wind. Advantageously, embodiments of the improved roof ridge vent disclosed herein offer proper air exhaustion and water drainage.

With reference to the Figures, a few particular embodiments of a roof ridge vent are shown. As further discussed herein, a first embodiment of a roof ridge vent is shown with the numeral 10, which includes relatively lower water crossover passages for roofs not having a ridge beam or for roofs having adequate clearance to a ridge beam. A second embodiment of a roof ridge vent is shown with the numeral 10A, which includes relatively steeper water crossover passages for roofs a ridge beam and a corresponding steeper pitch. A third embodiment of a roof ridge vent is shown with the numeral 10B, which does not include a hinged flap and a baffle. It should be appreciated that roof ridge vent 10, roof ridge vent 10A, and roof ridge vent 10B are similar in structure and function, except as disclosed elsewhere herein. Thus, to the extent certain similar components are only described relative to first roof ridge 10, the disclosure herein also includes these similar components relative to second roof ridge vent 10A and third roof ridge vent 10B. The Figures also offer additional details in this regard.

Figure 6:
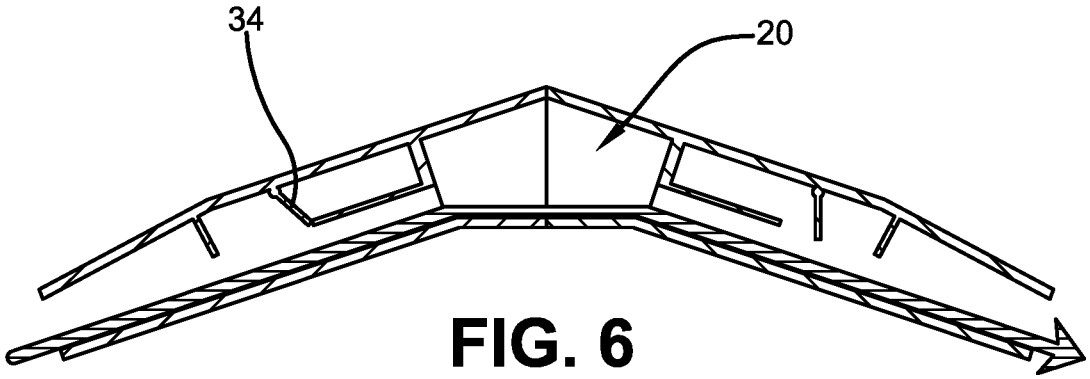
FIG. 6 is a sectional view of the roof ridge vent of FIG. 1, showing a path of wind driven rainwater through a water cross-over passage, shown with a hinged flap in a closed position.

With specific reference to FIGS. 1 to 3 and FIG. 6, roof ridge vent 10, which may also be referred to as a vent 10, a vent assembly 10, a roof ridge assembly 10, or a roofing assembly 10, includes a lower assembly 12 capped by an upper cover 14. As perhaps best seen in FIG. 6, the upper cover 14 is spaced from the lower assembly 12, via water crossover passages 20 (FIG. 2), in order to form inlet and outlet wind channels. The inlet and outlet wind channels start at respective openings, which may also be referred to as open ends, which are near ends of the lower assembly 12 and the upper cover 14. Depending on the wind speed and direction, a first open end between the lower assembly 12 and upper cover 14 provides a wind inlet, and the other open end between the lower assembly 12 and upper cover 14 provides a wind outlet. In FIG. 6, the left open end and left wind channel are shown as the wind inlet and the right open end and right wind channel are shown as the wind outlet. The wind and water crossover passages 20 also allow for water (e.g., wind-driven rain and any collected water) to pass from the inlet wind channel to the outlet wind channel for drainage to prevent accumulation of water at one side. As further discussed herein, air which exhausts from an attic can generally exit at either open end.

A bottom of lower assembly 12 will be installed generally flush against a top of a roof. In the installed position, and as further described herein, roof ridge vent 10 allows hot air inside the attic to exhaust, while also allowing for fresh air to replace the exhausted air. As also further described herein, roof ridge vent 10 also suitably drains collected water, which water may have been driven by strong winds up the slope of the upwind side of the roof to the downwind side of the roof via the water crossover passages 20.

Moreover, since ventilation is generally existent at lower parts of the roof, such as at the eves, fresh air can enter the roof space through those vents, or from elsewhere, where the air becomes heated, rises, and can exits both sides of the ridge vent 10 on windless or low wind days. For embodiments of the ridge vent 10 that have hinged flaps, the flap on the upwind side may be forced shut, which would prevent air from backflowing into the upwind exhaust passage, and on the downwind side of the vent, a low pressure area would develop as the air passes over the ridge of the roof, which would result in an increase of exhaust air flow from the downwind side of the vent. With the upwind flap closed, this will help pull hot air from the attic.

In the installed position, roof ridge vent 10 will be positioned along a ridge of the roof. Roof ridge vent 10 will generally extend an entire length of the roof, and a portion of lower assembly 12 will be positioned on the top of the roof. Roof ridge vent 10 should be suitably mounted on the top of the roof, in order to not allow insects and undesired weather (e.g., wind, rain, snow) to enter the mounting space between roof ridge vent 10 and the roof. If a roof already includes roofing material (e.g., shingles, metal, slate, shakes) or other roof components, roof ridge vent 10 can be installed over the roofing material, though any conventional roof ridge vent should be removed before installing roof ridge vent 10. In other embodiments, roof ridge vent 10 can be installed in conjunction with a newly installed roof, in which case, roof ridge vent 10 can be installed with the new roof. For roofs that do not currently have a ridge vent, the crest of the roof sheathing should be cut back along the crest to open the top of the roof up for ventilation.

Figure 1:
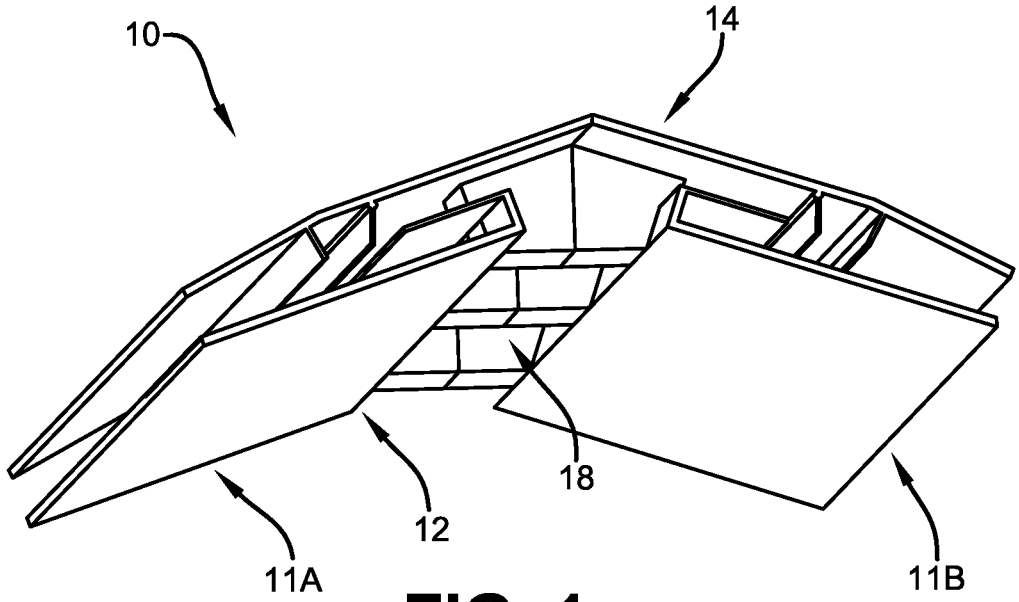
FIG. 1 is a perspective view of a first embodiment of a roof ridge vent, which includes relatively lower water crossover passages for roofs not having a ridge beam or for roofs having adequate clearance to a ridge beam.
Figure 2:
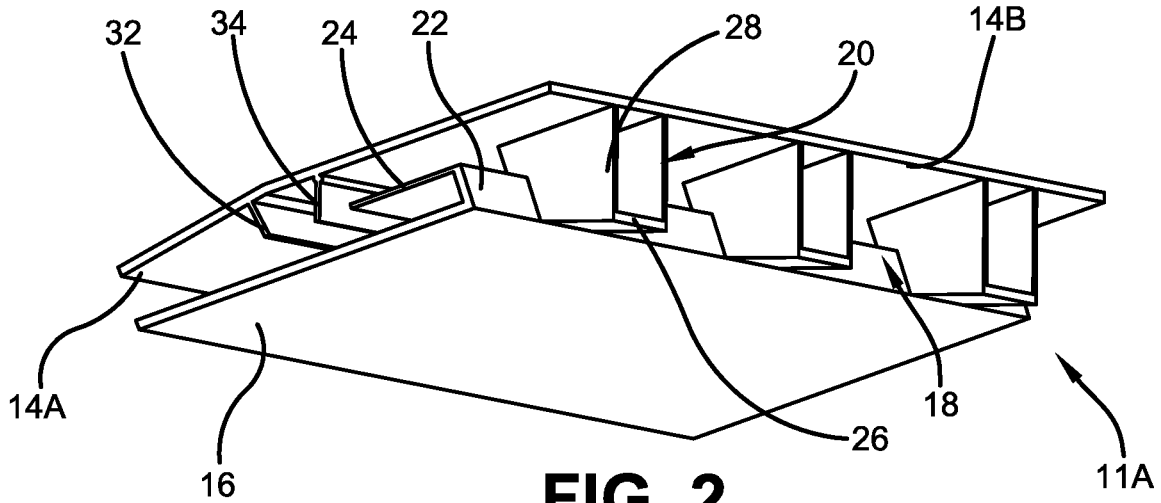
FIG. 2 is a perspective sectional view of the roof ridge vent of FIG. 1.
Figure 3:
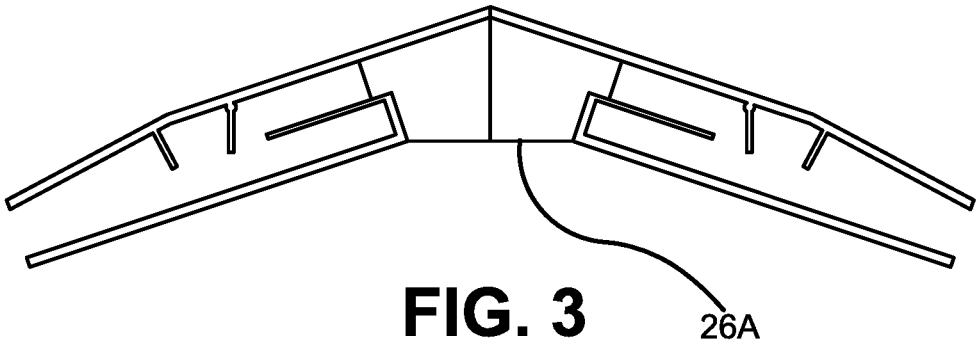
FIG. 3 is an end view of the roof ridge vent of FIG. 1.

As particularly shown in FIGS. 1 and 2, roof ridge vent 10 includes a first half 11A which generally mirrors a second half 11B. As suggested above, first half 11A may be securely fastened with second half 11B, or in other embodiments, may be unitary with second half 11B. First half 11A may be identical with second half 11B, though with mirrored components. In other embodiments, first half 11A may be slightly different than second half 11B (e.g., different pitches) as might be desired to correspond with a particular roof.

Lower assembly 12 includes a bottom portion 16 which will be particularly positioned on the top of the roof (not shown). Bottom portion 16 should be securely fastened (e.g., via nails, screws, or other adhesive) with the roof. The pitch of bottom portion 16 can match any suitable corresponding pitch of the roof.

Figure 5:
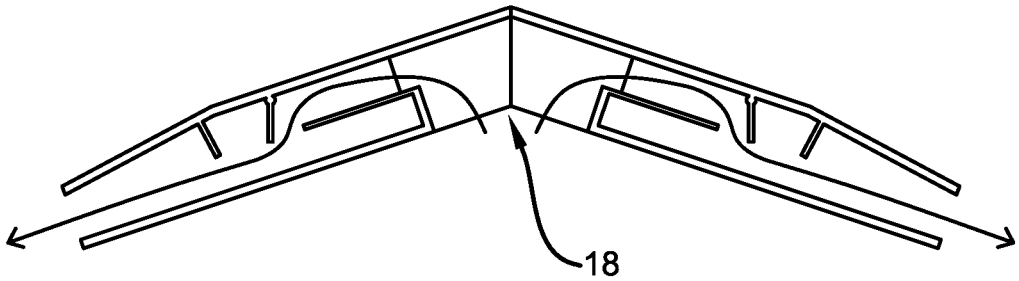
FIG. 5 is a side view of the roof ridge vent of FIG. 4, showing a path of hot air being exhausted through exhaust passages.

Between bottom portion 16 of first half 11A and bottom portion 16 of second half 11B are one or more exhaust paths 18. Exhaust paths 18 should be sized appropriately as to allow for exhausting air from an upper part of a building, such as an attic (not shown). Another example of an upper part of a building is a top of an industrial type building in which there is no separate attic space, instead having just an open space from the floor to the roof. Improper or insufficient ventilation can cause problems, such as overheating, moisture buildup, and mold. The path of exhausting air through exhaust paths 18 and out of roof ridge vent is particularly shown in FIG. 5. The amount of exhaust air will depend on the wind and temperature conditions. As generally known, hot air will naturally rise and exhaust, and the exiting air will create a negative pressure which thereby pulls fresh air into the attic through other unrelated vents or openings to replace the exiting air.

Exhaust paths 18 are generally defined by the space between respective pairs of water crossover passages 20, which water crossover passages 20 will be further described herein. Further exhaust paths 18 may exist between end water crossover passages 20 and respective closed-in ends (not shown) of roof ridge vent 10. The ends may be closed with a cap at each end, which again may be a separate (and secured) piece or part of a unitary assembly with another component. In this same context, an overall roof ridge vent assembly 10 could include several individual lengths of intermediate vent assemblies in which the ends are open at each end, where the individual assemblies at each end would be capped off on the end.

Bottom portion 16 extends upward to a baffle having baffle ends 22 and a baffle top 24. The baffle generally serves to prevent collected water from spilling thereover and otherwise entering the attic. Baffle ends 22 and baffle top 24 generally separate air flow between the upper (exhaust) and lower (wind/water crossover) paths of the vent. This is perhaps best seen in FIG. 7.

Figure 4:
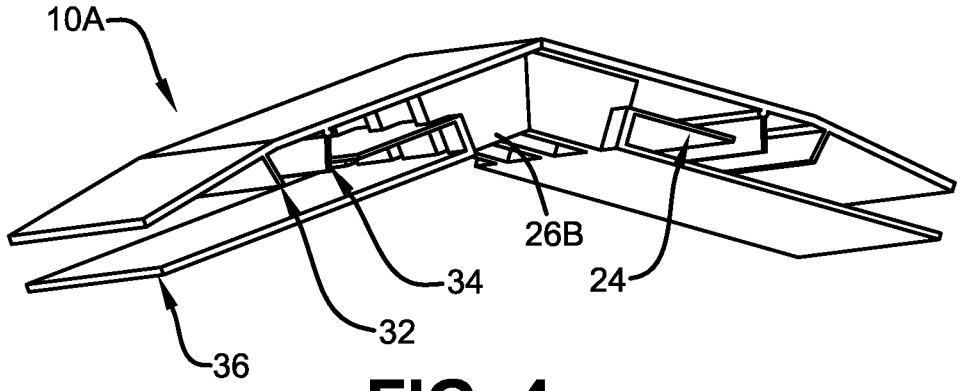
FIG. 4 is a perspective view of a second embodiment of a roof ridge vent, which includes relatively steeper water crossover passages for roofs having a ridge beam and a corresponding steeper pitch.
Figure 7:
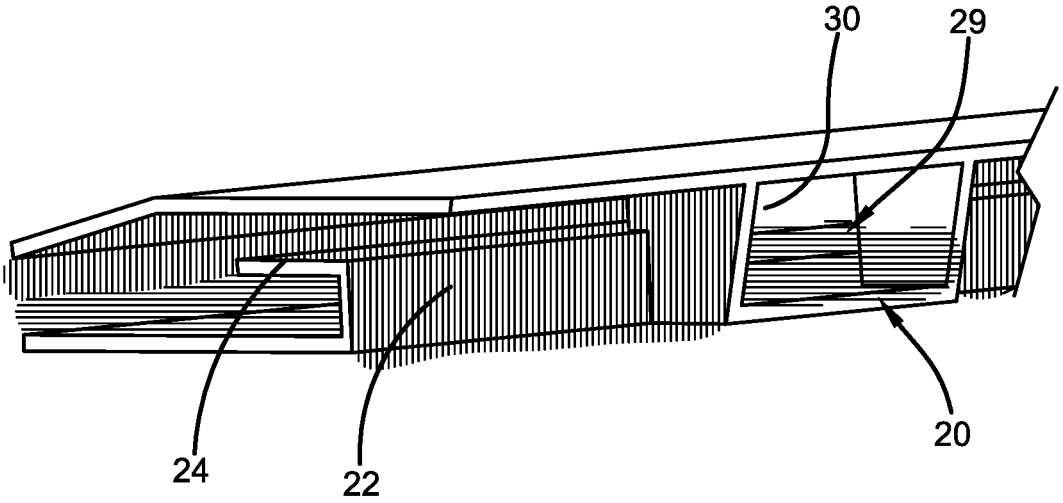
FIG. 7 is a partial sectional view of the roof ridge vent of FIG. 4, showing both an exhaust passage and path and a water cross-over channel and path.
Figure 8:
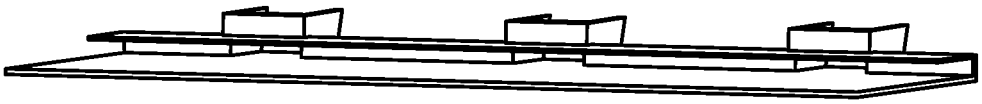
FIG. 8 is a perspective view of a portion of an internal assembly of the roof ridge vent of FIG. 4.
Figure 9:
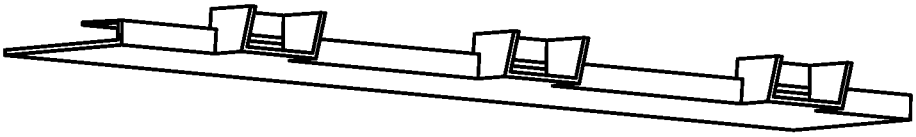
FIG. 9 is an alternative reverse perspective view of the portion of the internal assembly of FIG. 8.
Figure 10:
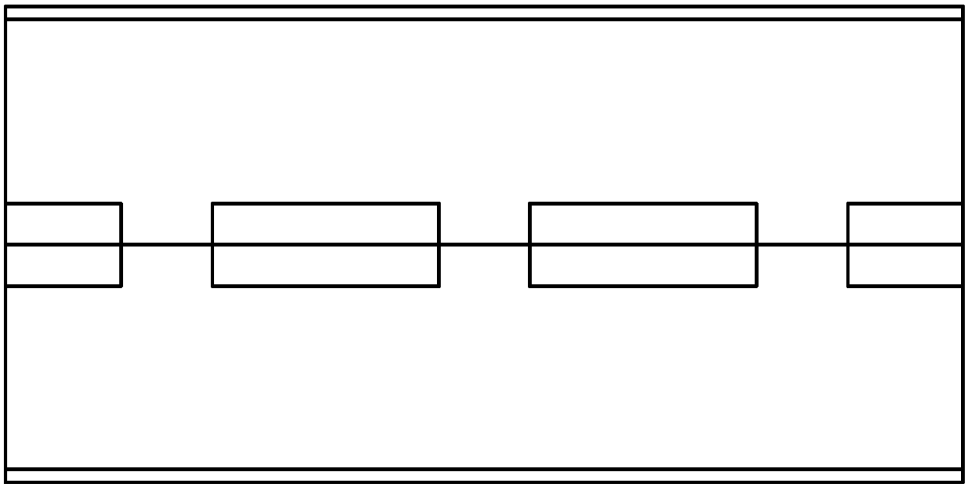
FIG. 10 is a bottom view of the roof ridge vent of FIG. 4.
Figure 13:
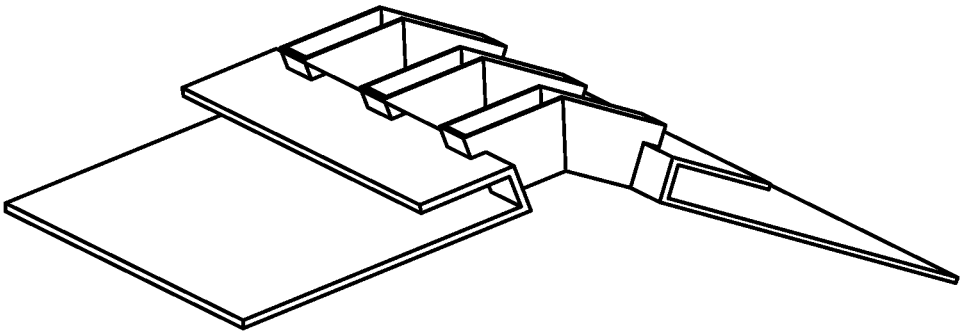
FIG. 13 is a perspective view of an internal assembly of the roof ridge vent of FIG. 4.
Figure 14:
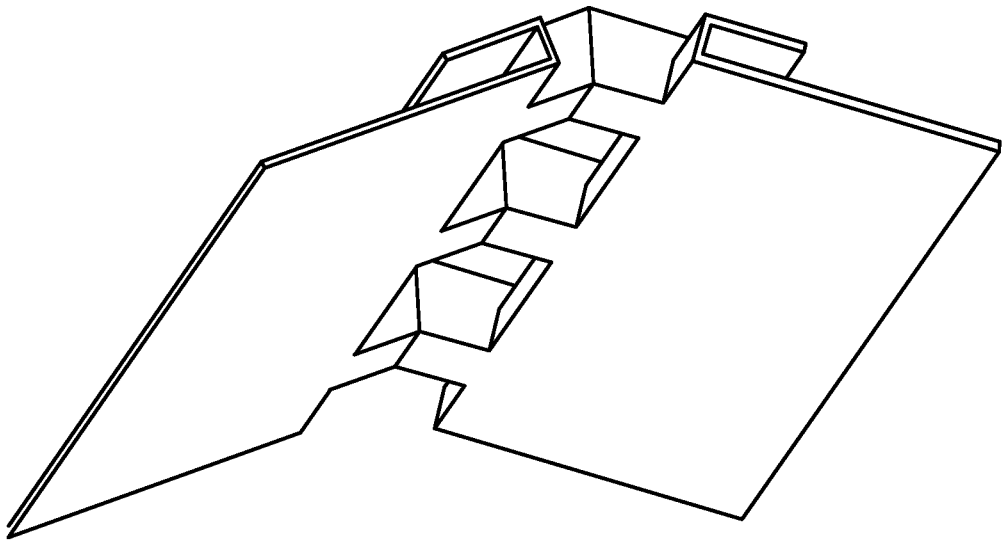
FIG. 14 is an alternative perspective view of the internal assembly of FIG. 13.
Figure 15:
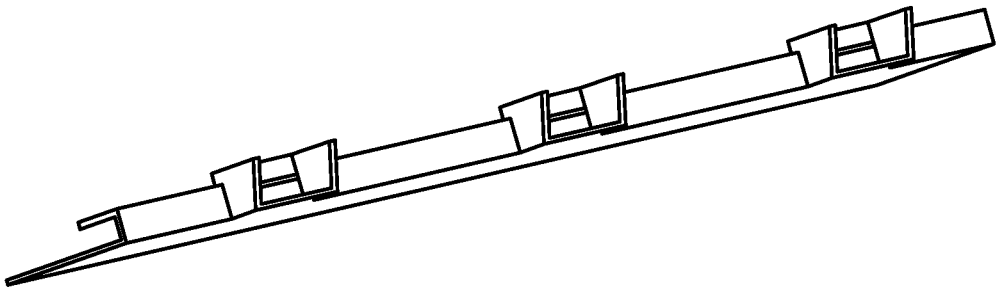
FIG. 15 is an alternative perspective view of the portion of the internal assembly of FIG. 8.
Figure 16:
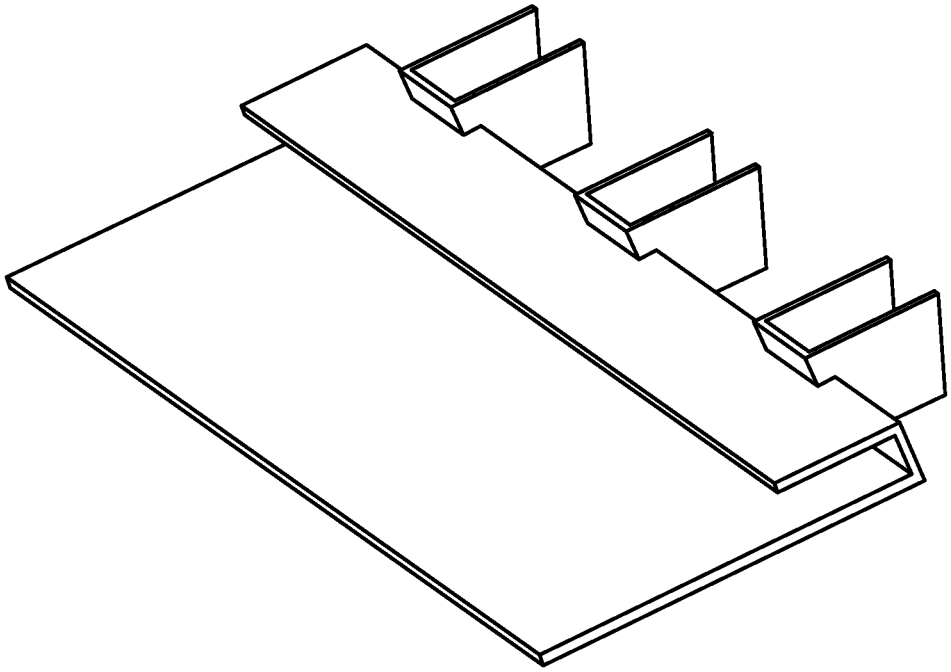
FIG. 16 is a further alternative perspective view of the portion of the internal assembly of FIG. 8.

As generally seen in FIGS. 4, 8, and 13, baffle top 24 can extend the entire length of roof ridge vent 10. As generally seen in FIG. 2 and FIGS. 7 to 9, the plurality of baffle ends 22 will be spaced by respective water crossover passages 20. The length of baffle ends 22 can be designed in connection with the size of openings 29 of water crossover passages 20 in order to achieve the one or more functions described herein.

Figure 18:
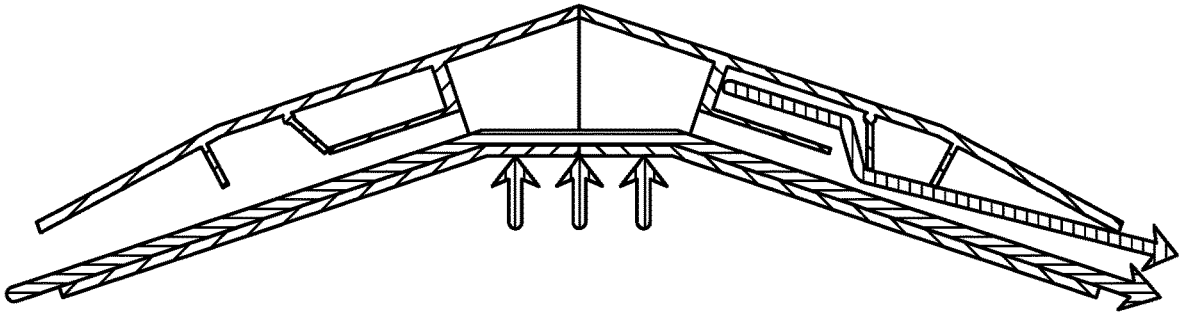
FIG. 18 is a sectional view of the roof ridge vent of FIG. 1 through a water crossover passage, showing a closed hinged flap and respective flows.
Figure 19:
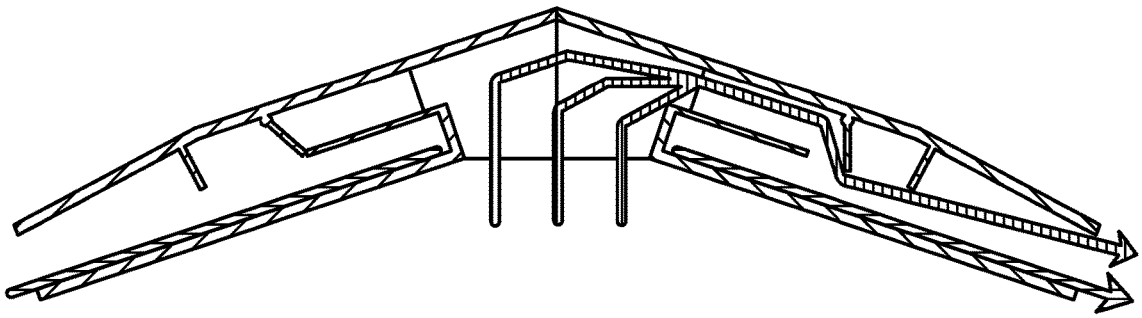
FIG. 19 is a sectional view of the roof ridge vent of FIG. 1 through an exhaust passage, showing a closed hinged flap and respective flows.

As perhaps best seen in FIGS. 6 and 7, water crossover passages 20 allow wind-driven rain and any collected water to pass over to the other side of the roof ridge vent 10 for drainage. This prevents accumulation at one side. As shown in FIG. 6, the drainage side can depend on the direction of the wind. That is, the wind will push the water from the wind inlet end to the wind outlet end. In FIG. 6, the wind is coming in from the left and will push the water out to the right. FIG. 6 shows a sectional view through one of the water crossover passages 20. That is, the direction of flow of the wind and the exhaust will generally be in the same direction, as shown in FIG. 18 and FIG. 19.

Moreover, when the wind is not blowing fast enough to push water to the other end, any collected water is able to drain out at each end based on gravity. The water crossover passages 20 and overall roof ridge vent 10 generally avoid stagnated water.

Water crossover passages 20 include a bottom 26 which can be shaped as to match the pitch of the roof. That is, roof ridge vent 10 (FIG. 1) includes a first bottom 26A (FIG. 3) having a flatter pitch and roof ridge vent 10A (FIG. 4) includes a second bottom 26B having a steeper pitch. Other pitches could be used in order to match a given roof. Roof ridge vent 10 can be compatible with flat profile roofs and metal roofs. For additional compatibility, inserts can be attached, where desired, between the bottom of the roof ridge vent 10 and the top of the roof surface.

First bottom 26A may be generally horizontal, which may be referred to as a 0/12 pitch or 0 degrees. First bottom 26A may be utilized where the peak of the roof is cut, which cutting might be done when installing roof ridge vent 10. This would allow for lowering the bottom to the level of 26A. This may not be possible where a roof has a ridge beam running along the top of the roof, in which case second bottom 26B might be utilized. Second bottom 26B may be any suitable angled pitch, which may be any pitch between 1/12 pitch and 15/12 pitch.

In one or more embodiments, bottom 26 may be flexible, which may also be referred to as being adjustable between the position of first bottom 26A and the position of second bottom 26B. The adjustable nature for bottom 26 may be provided by a hinge or another suitable components. Other components of roof ridge vent 10 may also be adjustable in order to accommodate an adjustable nature for bottom 26.

The bottom 26 extends laterally between lower ends of a pair of sidewalls 28. The sidewalls 28 and bottom 26, and a deflector 30 if present, serve to define opening 29 (FIG. 7) through which wind and water can pass from one water crossover passage 20 of first half 11A to another corresponding water crossover passage 20 of second half 11B for eventual outlet thereof.

Water crossover passages 20 may include deflector 30 (FIG. 7), which may also be referred to as a generally vertical baffle 30. Where present, deflector 30 generally serves to deflect and separate water out of the air blowing through roof ridge vent 10. Deflector 30 extends between upper portions of the pair of sidewalls 28.

Though the Figures show three water crossover passages 20, other suitable numbers may be utilized. The amount of and size of water crossover passages 20 might be designed based on the amount of expected water.

Figure 11:
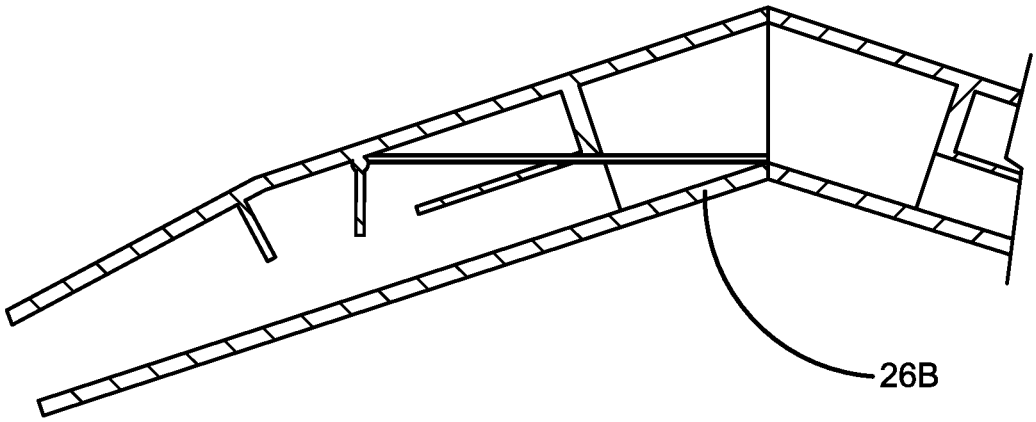
FIG. 11 is a partial sectional view of the roof ridge vent of FIG. 4, generally showing a height of a water overflow dimension being compared with a height of a wind exhaust dimension.
Figure 12:
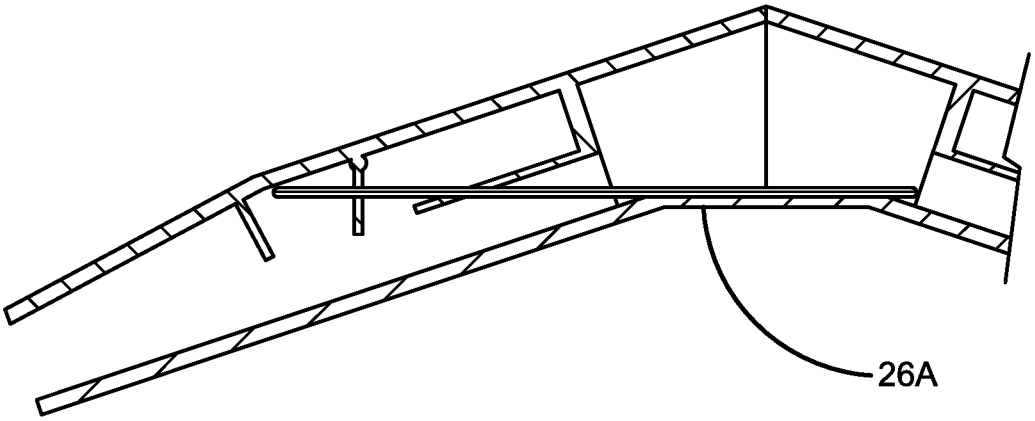
FIG. 12 is a partial sectional view of the roof ridge vent of FIG. 1, generally showing an alternative height of a water overflow dimension being compared with an alternative height of a wind exhaust dimension.

Turning back to the baffle design in connection with the water crossover passages 20, as generally seen in FIGS. 11 and 12, the height of the uppermost portion of baffle top 24 in relation to the height of the uppermost portion of the bottom (e.g., bottom 26A, bottom 26B) may vary based on varying roof pitches. This should be designed in order to generally avoid stagnated water. That is, the internal geometry should allow the collected water to spill over to the other water crossover passages 20. This should occur prior to the water level becoming too high as to spill over the baffle top 24 and baffle ends 22 and into the exhaust passages 18 and enter the attic. In FIGS. 11 and 12, the horizontal line represents the top of the wind-driven (wind coming from the left) and collected water. Any suitable difference between the bottom of the water crossover passage 20 and the height of baffle top 24 and baffle end 22 which prevents spilling into the exhaust section 18 can be utilized.

Moreover, the spacing of the baffles in connection with the water crossover passages 20 may be based on the design of the existing roof. For example, roofs built with prefabricated trusses may need the water crossover passages to be spaced such that the water crossover passages 20 lie between the peaks of the trusses. This may include spacing water crossover passages 20 in fractions of the dimensions that trusses are spaced per building code (e.g., 16" and 24" spacing). The spacing between water crossover passages 20 may also be considered relative to the design of bottom 26, such as utilizing the suitable spacing when first bottom 26A having the flatter pitch is installed.

As mentioned above, roof ridge vent 10 includes lower assembly 12 being capped and protected by an upper cover 14. Upper cover 14 should be designed in order to offer protection from weather (e.g., hail). As shown in the Figures (e.g., FIG. 2 and FIG. 3) each side of upper cover 14 may include a first pitch portion 14A and a second pitch portion 14B, which may be for design purposes or for improved drainage of rainwater. In other embodiments, upper cover 14 has a single pitch for each side. In one or more embodiments, each side of upper cover 14 can have the same or similar pitch. In other embodiments, each side of upper cover 14 can have a different pitch in order to match a roof having different pitches.

Upper cover 14 may have a deflector 32, which may also be referred to as a generally vertical baffle 32, extending downward therefrom. As with deflector 30, where present, deflector 32 generally serves to deflect and separate water out of the air blowing through roof ridge vent 10. The angle, amounts, and position of deflector 32 can be adjusted to meet a desired design.

Upper cover 14 may have a hinged flap 34 extending downward therefrom. Hinged flap 34, which may also be referred to as an upwind flap 34, may be utilized in order to provide a closed position against the baffle top 24 upon sufficient wind speed (FIG. 6). That is, as the wind speed on the upwind side increases (i.e., left side of FIG. 6), upon sufficient speed to overcome the hinge force, the wind will push the flap 34 over to the baffle top 24 to thereby close off the upwind exhaust passage 18 exiting the attic. With sufficient wind speed, the attic exhaust on the upwind side would effectively be closed off. This closing function would generally serve to prevent wind and any water therein from entering the upwind exhaust passage 18 and the attic. Other Figures, (e.g., FIG. 2) shows the wind speed not being high enough to cause flap 34 to close.

In one or more embodiments, the movement of hinged flaps 34 may be further controlled with one or more springs. Either the hinge can include a spring or a spring can be positioned such that hinged flap 34 is required to push against the spring and overcome the spring force in order to move to the closed position. That is, the use of a spring will generally serve to increase the wind speed which is required to push the flap 34 over to the baffle top 24 to thereby close off the exhaust passages 18 exiting the attic. An exemplary spring is a bimetallic thermally actuated spring.

In one or more embodiments, the movement of hinged flaps 34 may be controlled with an external assembly, such as an electronic control and actuation system.

Where present, hinged flap 34 can also increase the effectiveness of exhausting air on the downwind side. A closed hinged flap 34 would create a lower pressure zone on the downwind side as the wind crests the ridge of the roof.

Another benefit of hinged flap 34, where present, during high winds is that air will be drawn from the space underneath the roof, which would help lower the pressure in the space under the roof. This would serve to help equalize the pressure differential between the top and bottom of the roof. As wind blows across a surface, the pressure decreases. High winds (e.g., from tornados and hurricanes) create a very low pressure on the top of the roof, which can be more pronounced for lower pitched roofs. This low pressure can cause the roof to be lifted off of the structure. By drawing air out of the space underneath the roof, the net pressure pulling up on the roof will generally be reduced.

Figure 17:
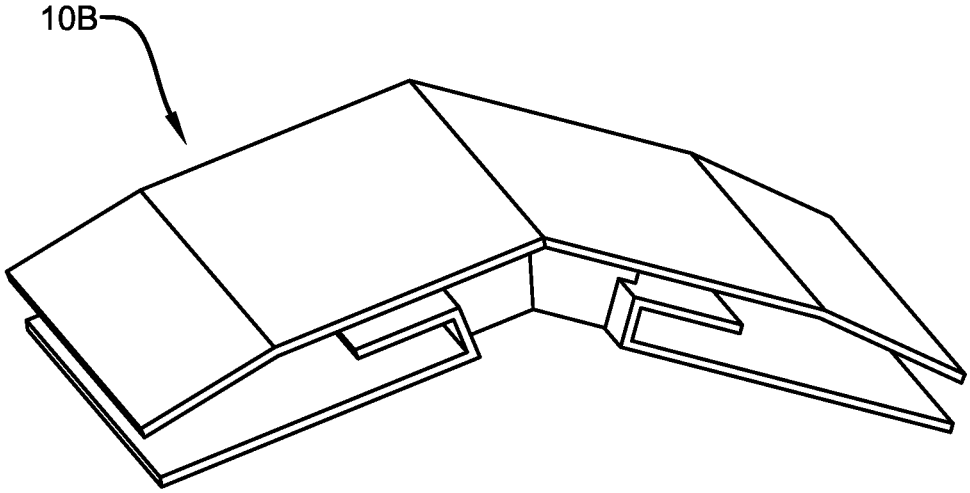
FIG. 17 is a perspective view of a third embodiment of a roof ridge vent, which does not include a hinged flap and a baffle.

As suggested above, the deflector and hinged flap may not be present in one or more embodiments, and therefore third roof ridge vent 10B is shown in FIG. 17 without a deflector and without a hinged flap. Third roof ridge vent 10B is otherwise similar to roof ridge vent 10, including the presence of the baffles and water crossover passages 20.

In one or more embodiments, a screen for preventing animals and insects from entering the attic can be used in one or more locations of roof ridge vent 10. For example, a screen can be placed at each end, as generally in the location of the numeral 36 in FIG. 4. A screen may also be placed at any other desired internal location.

Though advantages and features are disclosed elsewhere herein, additional advantages are disclosed here. The roof ridge vent disclosed herein, can generally avoid accumulating debris from trees, can generally avoid accumulating snow and ice, and is effective at preventing wind-driven rain from collecting even on roofs with a small slope and even on roofs with a sagging ridge line. The roof ridge vent disclosed herein can also generally function even during hurricanes when strong wind blows in a constant direction for an extended period of time.

Generally speaking, respective components disclosed herein may be either fastened together as separate components, or may be unitarily made as a single assembly. That is, in one or more embodiments, respective components are securely fastened (e.g., glue, snapped together, nails, screws). And in other embodiments, respective components may be a unitary assembly. Components of roof ridge vent 10 may be made of any suitable materials, such as wood, plastic, and metal.

For installation of roof ridge vent 10, a vent, which may be referred to as an air slot, can be first cut in the roof at the peak. This air slot will then be covered by roof ridge vent 10. Roofing material (e.g., shingles, metal, slate, shakes) and other roof components can be installed on the roof prior to installation of roof ridge vent 10. That is, roof ridge vent 10 can be installed over the roofing material. Additional roofing material can also be installed over roof ridge vent 10 for further protection and design. Roof ridge vents 10 made of metal may not require the use of additional roofing material (e.g., shingles). Roof ridge vent 10 can be installed on the roof by any suitable manner, including adhesives, fasteners, and being snapped into place. This can include fastening the roof ridge vent 10 generally around the perimeter thereof. Other aspects of installation may be generally known to the person of reasonable skill in the art.

In light of the foregoing, the present invention advances the art by providing an improved roof ridge vent. While particular embodiments of the invention are disclosed herein, the invention is not limited thereto or thereby inasmuch as variations will be readily appreciated by those of ordinary skill in the art. The scope of the invention shall be appreciated from the claims that follow.

What is claimed is:

1. A roof ridge vent for exhausting air and draining water, the roof ridge vent comprising a lower assembly capped by an upper cover, the lower assembly and the upper cover being spaced apart via a plurality of water crossover channels to thereby form an inlet wind channel between first portions of the lower assembly and the upper cover and an outlet wind channel between second portions of the lower assembly and the upper cover;

the plurality of water crossover channels being configured to receive wind through respective openings therein to allow the wind and collected water to pass from the inlet wind channel to the outlet wind channel for drainage of the collected water; and a plurality of exhaust paths defined via spacing between respective pairs of the plurality of water crossover channels, the plurality of exhaust paths being configured to allow air to exhaust from an attic in an in-use configuration, the plurality of exhaust paths being adapted to allow the exhaust air to travel therethrough before exiting one or more of the inlet wind channel and the outlet wind channel.

2. The roof ridge vent of claim 1, further comprising a first baffle having respective first baffle ends and a first baffle top, the respective first baffle ends being spaced apart by the plurality of water crossover channels.

3. The roof ridge vent of claim 2, the first baffle extending from a first bottom portion of the lower assembly, the roof ridge vent further including a second baffle having respective second baffle ends and a second baffle top, the respective second baffle ends being spaced apart by the plurality of water crossover channels, the second baffle extending from a second bottom portion of the lower assembly.

4. The roof ridge vent of claim 2, further comprising a hinged flap extending downward from the upper cover for providing a closed position against the first baffle top upon sufficient speed of the wind.

5. The roof ridge vent of claim 4, further comprising a second hinged flap extending downward from the upper cover for providing a closed position against the second baffle top upon sufficient speed of the wind.

6. The roof ridge vent of claim 3, the plurality of water crossover channels, the first baffle, and the second baffle being configured such that the collected water generally drains from the outlet wind channel rather than overcoming the baffles.

7. The roof ridge vent of claim 5, further comprising a first spring acting against the hinged flap and a second spring acting against the second hinged flap, such that the first spring and the second spring generally serve to increase the wind speed which is required to push the hinged flap and the second hinged flap to the closed positions.

8. The roof ridge vent of claim 7, where the first spring and the second spring are bimetallic thermally actuated springs.

9. The roof ridge vent of claim 5, further comprising a first spring within a hinge of the hinged flap and a second spring within a second hinge of the second hinged flap, such that the first spring and the second spring generally serve to increase the wind speed which is required to push the hinged flap and the second hinged flap to the closed positions.

10. The roof ridge vent of claim 5, where movement of the hinged flap and movement of the second hinged flap are controllable with an electronic control and actuation system.

11. The roof ridge vent of claim 1, the lower assembly including a first bottom portion and a second bottom portion, the first bottom portion and the second bottom portion being spaced to further define the plurality of exhaust paths.

12. The roof ridge vent of claim 1, the plurality of water crossover channels including respective bottoms which are shaped to match a pitch of a desired roof to which the roof ridge vent will be installed in the in-use configuration.

13. The roof ridge vent of claim 12, where the respective bottoms are generally horizontal in order to match a 0/12 pitch roof.

14. The roof ridge vent of claim 12, where the respective bottoms are angled to match a pitch between 1/12 pitch and 15/12 pitch.

15. The roof ridge vent of claim 12, where the respective bottoms are adjustable between a generally horizontal position and an angled position.

16. The roof ridge vent of claim 12, the plurality of water crossover channels further including a pair of respective sidewalls, the respective bottom extending between lower ends of the pair of respective sidewalls.

17. The roof ridge vent of claim 16, the plurality of water crossover channels further including a deflector extending between upper portions of the pair of respective sidewalls.

18. The roof ridge vent of claim 1, where the roof ridge vent is installed on an existing roof such that the lower assembly is installed on the existing roof.

19. The roof ridge vent of claim 1, where the roof ridge vent is installed with a new roof.

* * * * *